US008739316B1

(12) United States Patent
Norton

(10) Patent No.: US 8,739,316 B1
(45) Date of Patent: Jun. 3, 2014

(54) PROTECTIVE HEADGEAR AND INSERTS

(75) Inventor: John K. Norton, Avon Lake, OH (US)

(73) Assignee: No Problem, Inc., Avon Lake, OH (US)

( * ) Notice: Subject to any disclaimer, the term of this patent is extended or adjusted under 35 U.S.C. 154(b) by 239 days.

(21) Appl. No.: 12/802,528

(22) Filed: Jun. 9, 2010

(51) Int. Cl.
*A42B 3/00* (2006.01)

(52) U.S. Cl.
USPC ..... 2/411

(58) Field of Classification Search
USPC ..... 2/2.5, 425, 411
See application file for complete search history.

(56) References Cited

U.S. PATENT DOCUMENTS

| | | | | |
|---|---|---|---|---|
| 1,705,879 | A | 3/1929 | Rodgers | |
| 3,133,289 | A | 5/1964 | Lipschutz | 2/195.6 |
| 3,197,784 | A | 8/1965 | Sheldon | 2/420 |
| 3,784,984 | A * | 1/1974 | Aileo | 2/423 |
| 3,843,970 | A | 10/1974 | Marietta et al. | 2/415 |
| 3,849,801 | A * | 11/1974 | Holt et al. | 2/413 |
| 4,282,610 | A | 8/1981 | Steigerwald et al. | 2/414 |
| 5,014,365 | A * | 5/1991 | Schulz | 2/412 |
| 5,173,970 | A | 12/1992 | Shifrin | 2/410 |
| 5,361,420 | A | 11/1994 | Dobbs et al. | 2/425 |
| 5,365,607 | A | 11/1994 | Benevento et al. | 2/181.4 |
| 5,515,546 | A | 5/1996 | Shifrin | 2/410 |
| 5,544,367 | A | 8/1996 | March, II | 2/410 |
| 5,661,854 | A | 9/1997 | March, II | 2/410 |
| 5,724,678 | A | 3/1998 | McCallum et al. | 2/209.13 |
| 5,729,830 | A * | 3/1998 | Luhtala | 2/2.5 |
| 5,930,841 | A | 8/1999 | Lampe et al. | 2/411 |
| 6,023,788 | A | 2/2000 | McCallum et al. | 2/209.13 |
| 6,088,840 | A * | 7/2000 | Im | 2/411 |
| 6,154,889 | A | 12/2000 | Moore, III et al. | 2/418 |
| D439,377 | S | 3/2001 | Dagan | D29/106 |
| D444,292 | S | 7/2001 | Wang | D2/882 |
| 6,289,522 | B1 * | 9/2001 | Jones et al. | 2/425 |
| 6,397,399 | B1 | 6/2002 | Lampe et al. | 2/425 |
| D503,260 | S | 3/2005 | Kim | D2/865 |
| 6,904,617 | B2 | 6/2005 | Tsai | 2/209.13 |
| 7,120,937 | B2 | 10/2006 | Monshouwer | 2/171 |
| 2002/0002733 | A1 * | 1/2002 | Keen | 2/425 |
| 2005/0160520 | A1 | 7/2005 | Forrest | 2/255 |
| 2006/0234577 | A1 * | 10/2006 | Wagner et al. | 442/135 |
| 2007/0281125 | A1 * | 12/2007 | Moore et al. | 428/71 |
| 2008/0172779 | A1 * | 7/2008 | Ferguson | 2/455 |
| 2008/0184457 | A1 * | 8/2008 | Pham | 2/209.13 |
| 2008/0250547 | A1 * | 10/2008 | Frank | 2/411 |

* cited by examiner

*Primary Examiner* — Katherine Moran
(74) *Attorney, Agent, or Firm* — Renner, Kenner, Greive, Bobak, Taylor & Weber

(57) ABSTRACT

An impact-absorbing insert for use in protective headgear includes an exterior surface defining an interior volume. The exterior surface may be formed by a plurality of layers joined together at seams. The interior volume contains a filler material. An impact-absorbing insert assembly includes a plurality of inserts connected together. Protective headgear adapted to protect a user includes a plurality of impact-absorbing inserts received in pockets.

5 Claims, 6 Drawing Sheets

PROTECTIVE HEADGEAR AND INSERTS

TECHNICAL FIELD

This invention relates to protective headgear such as might be worn by participants in a sporting event. More particularly, this invention relates to such headgear that takes on the appearance of a conventional cap but which is provided with padded inserts.

BACKGROUND ART

Protective headgear of various varieties is worn by participants in many different sporting events. For example, helmets are always worn by those participating in sports such as football and hockey, and a batting helmet is worn by a baseball player when batting or running the bases. These batting helmets can be sized to fit over an existing baseball cap, or can be worn directly on the head, but they are removed when the player takes the field for defensive purposes. However, the baseball player is still at risk of head injury while in the field, but it would not be practical for the cumbersome batting helmet to be worn by all players while in the field.

Thus, the need exists for a protective headgear which takes on the configuration and appearance of a conventional cap without impeding the ability of the user to move about with the hat in place.

DISCLOSURE OF THE INVENTION

It is thus an object of an aspect of the present invention to provide protective headgear.

It is an object of another aspect of the present invention to provide impact-absorbing inserts for use in protective headgear.

It is an object of another aspect of the present invention to provide impact-absorbing insert assemblies for use in protective headgear.

These and other objects of the present invention, as well as the advantages thereof over existing prior art forms, which will become apparent from the description to follow, are accomplished by the improvements hereinafter described and claimed.

In general, an impact-absorbing insert for use in protective headgear includes an exterior surface defining an interior volume, and a filler material in the interior volume.

In accordance with another aspect of the invention, an impact-absorbing insert assembly for use in protective headgear includes a plurality of inserts, each insert being attached to an adjacent insert. The inserts have an exterior surface defining an interior volume, and a filler material is provided in the interior volume.

In accordance with yet another aspect of the invention, protective headgear adapted to protect a user includes a plurality of impact-absorbing inserts. Each insert has an exterior surface defining an interior volume, and a filler material is provided in the interior volume.

Protective headgear and inserts therefor constructed according to the concepts of the present invention are shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
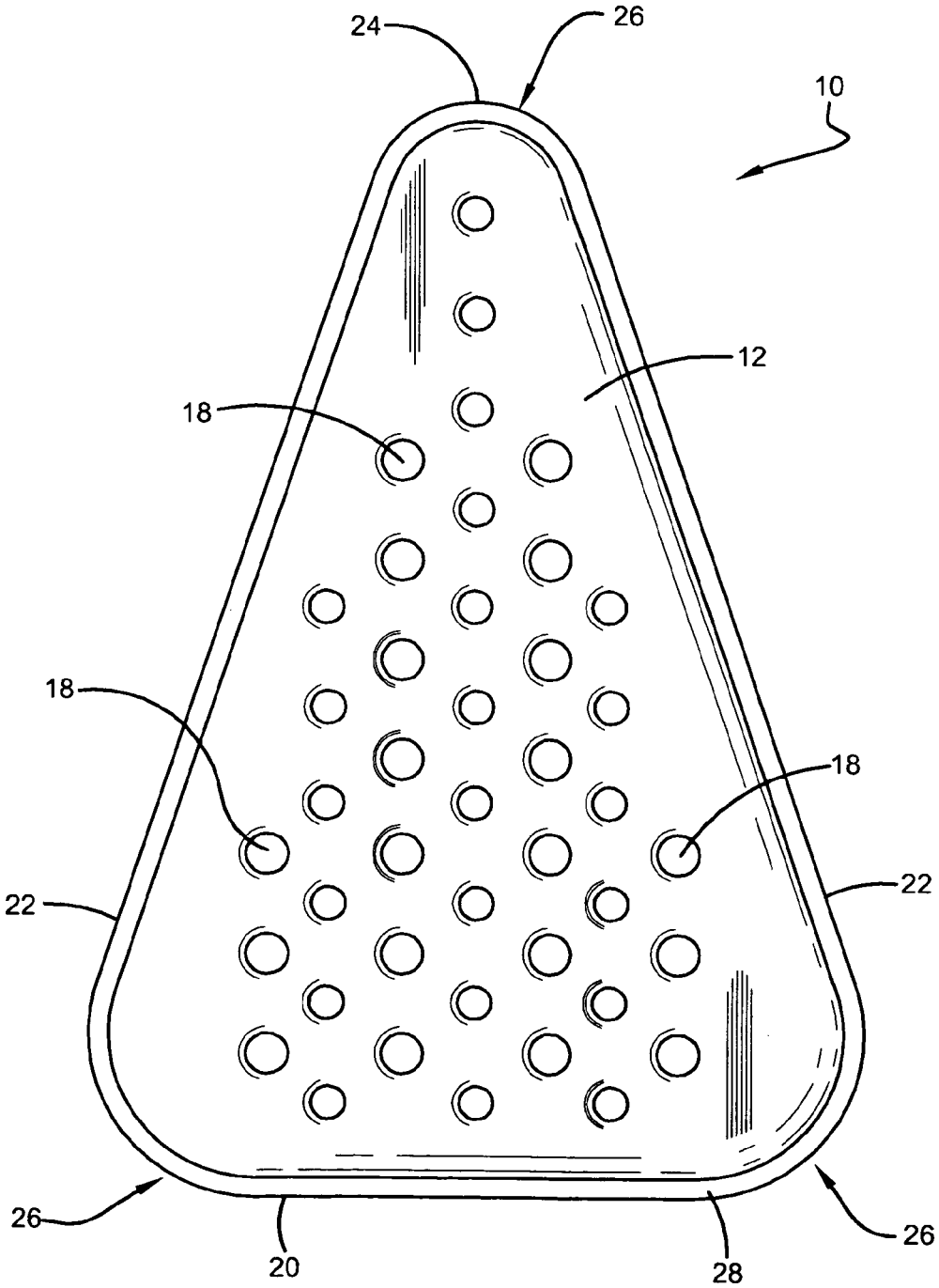
FIG. 1 is a plan view of an impact-absorbing insert constructed according to the concepts of the present invention.
Figure 2:
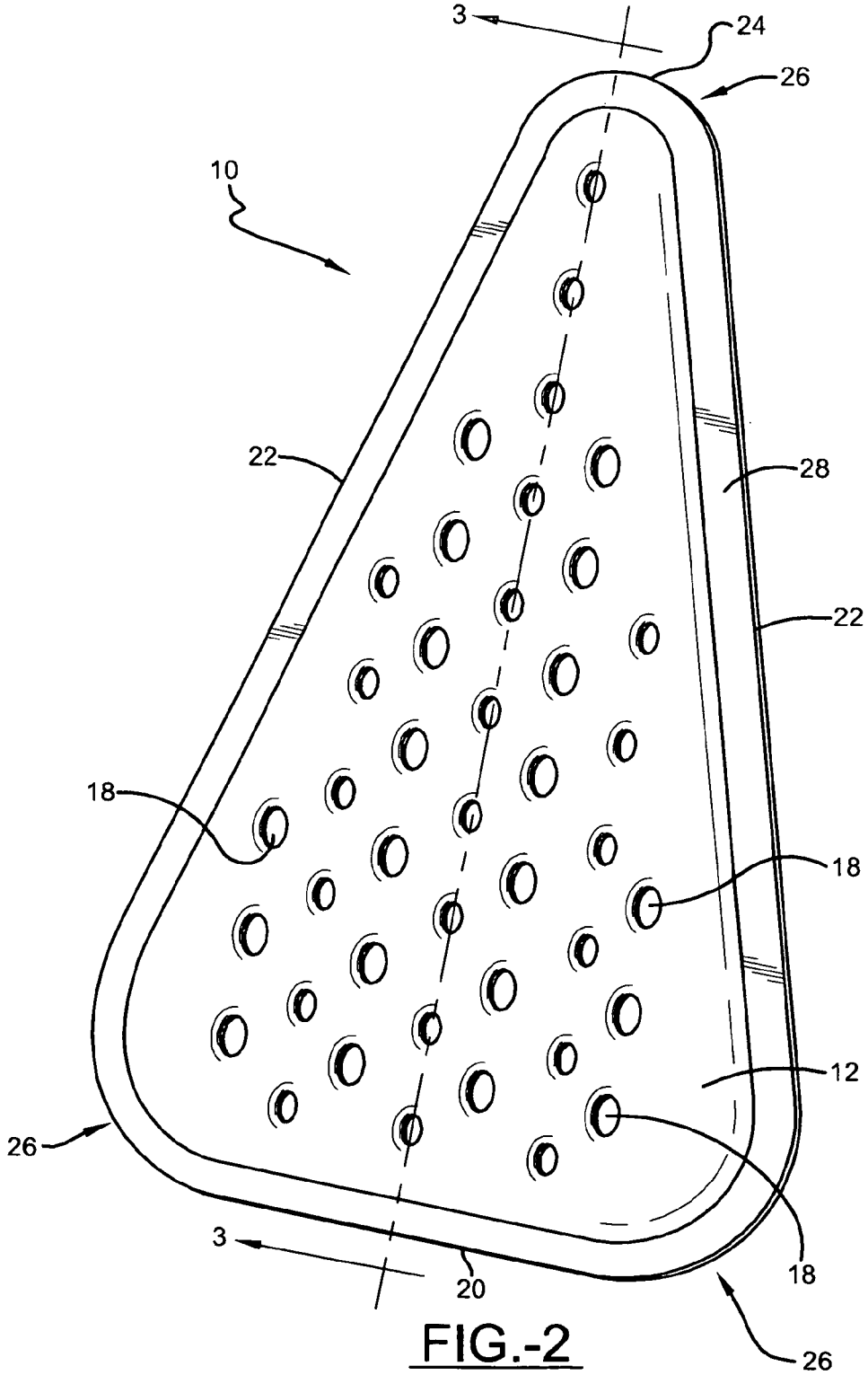
FIG. 2 is a perspective view of the insert of FIG. 1.
Figure 3:
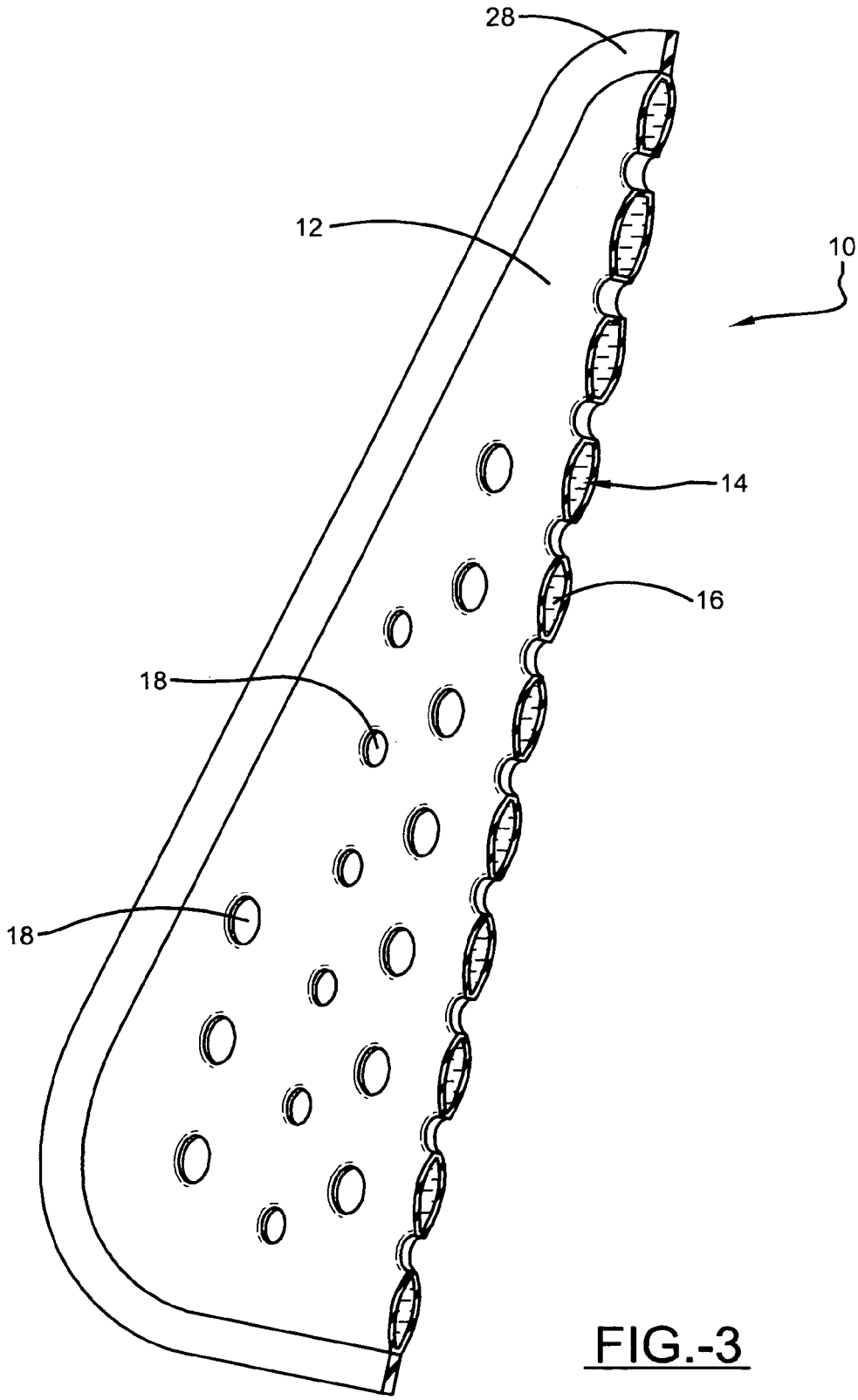
FIG. 3 is a view of the insert of FIGS. 1 and 2, fragmented along line 3-3 of FIG. 2.

An impact-absorbing insert for use in protective headgear made in accordance with the concepts of the present invention is generally indicated by the numeral 10. Insert 10 is hollow and functions essentially as a bladder and includes an exterior surface 12 that defines within it an interior volume 14. Interior volume 14 contains an impact-absorbing filler material 16. Insert 10 may include a plurality of apertures 18 therethrough, which can provide ventilation and can help dampen impacts.

Insert 10 is generally triangular having a base 20, sides 22 and a vertex 24 opposite base 20. The triangular shape of insert 10 is generally designed to conform to the shape of panels in a conventional cap and insert 10 is constructed of flexible materials so as to conform to the curvature of the cap and a user's head. Insert 10 may have rounded corners 26 at the intersection of sides 22 and base 20 and at the intersection of the two sides 22.

The exterior surface 12 is chosen to be sufficiently resilient and flexible for sustaining impacts and being incorporated into protective headgear. The thickness, composition, color, clarity, and other qualities of exterior surface 12 may be chosen based on a particular application. As such, exteriors 12 may be made of vinyl, polyethylene, or polypropylene, or any other suitable material. In one or more embodiments, exterior surface 12 could include a plurality of thin layers that are joined together at seams, such as at 28, which are formed by any appropriate method (including, for example, heat sealing, RF welding, sonic welding, and others known in the art).

The filler material 16 is chosen to absorb impact, and may be selected from a number of fluid materials or other substances depending on the given application. For example, filler material 16 could be air or any other non-flammable, non-toxic gas. Filler material 16 could also include a shear thickening fluid, such as the product sold under the trademark d3o sold by the British company d3o Lab. Other examples of suitable filler material include silica particles dispersed in ethylene glycol, impact protection textiles such as those sold by the Dow Corning Company or those sold by DuPont under the Kevlar name, gels having appropriate impact rates such as those sold by Impact Gel, any low class silicone gel such as the F-15 A/B product sold by BJB Enterprises, Inc., or any combination of suitable filler materials.

Figure 5:
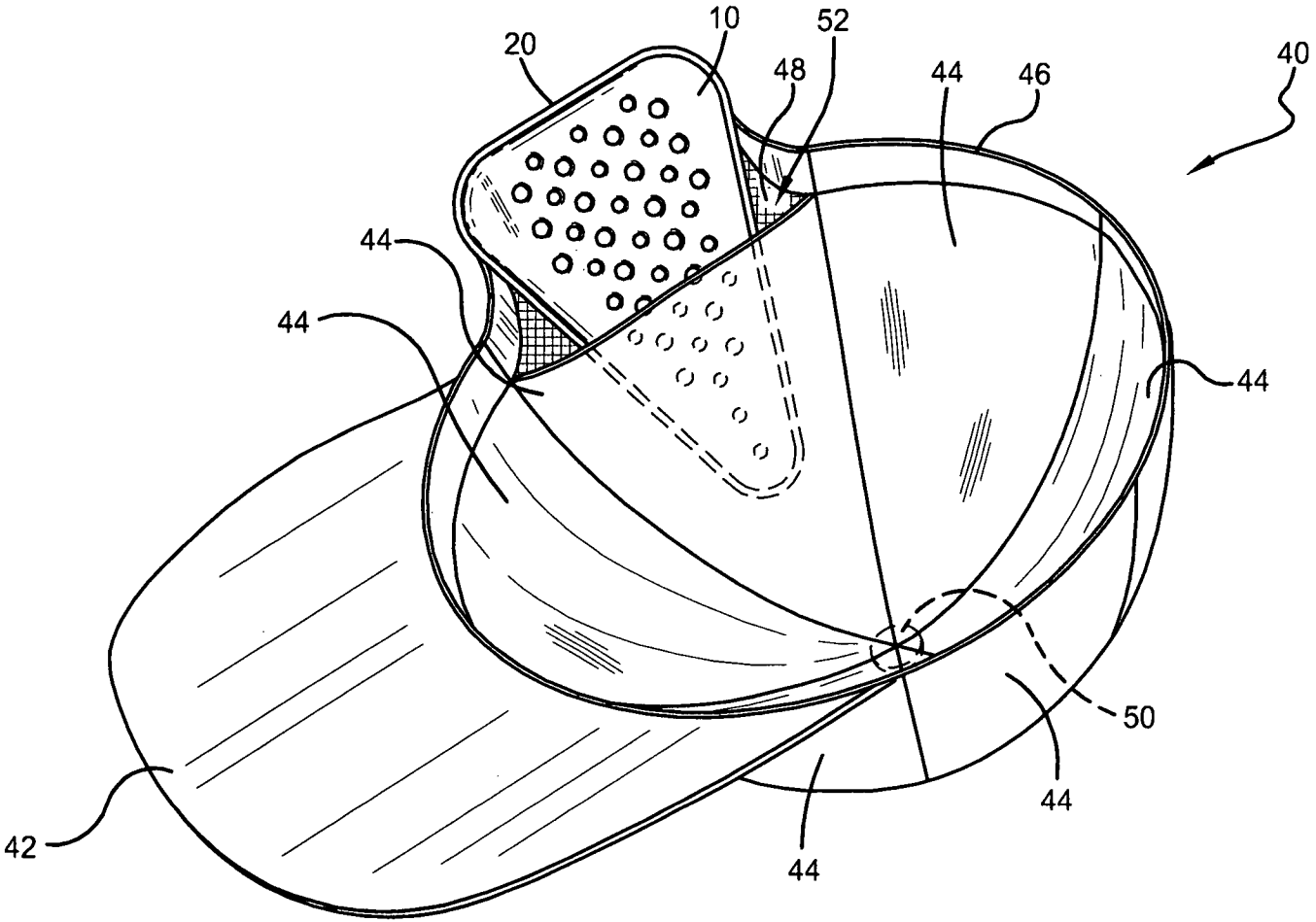
FIG. 5 is a bottom perspective view of a protective headgear cap showing an insert partially placed into the pocket of a panel of the cap.

Inserts constructed in accordance with the concepts of the present invention may be incorporated into protective headgear. As shown in FIG. 5, protective headgear 40 takes on the form of a conventional cap, and includes a fabric-covered reinforced bill 42 and six panels 44. Panels 44 generally take on the shape of an isosceles triangle, with each panel having a base 46, sides, and vertex. Protective headgear 40 includes openings 48 at the bases 46 of panels 44. It will be appreciated that openings 48 give access to pockets 52 that take on the general shape of panels 44 and have fabric material situated on either side of the pockets 52. Protective headgear 40 includes a button grommet 50 (shown in phantom in FIG. 5) at the juncture of the vertices of the various panels 44. An individual insert, such as an insert 10, is placed through opening 48 into pocket 52 so that the vertex 24 of insert 10 is situated proximate button grommet 50, and base 20 of insert 10 is situated approximate base 46 of headgear 40. To maximize protection, inserts are installed into all pockets 52 of all panels 44, though other configurations could also be used. For example, a user might find it sufficient to place inserts in only the front pockets adjacent bill 42. In addition, the inserts disclosed herein may be incorporated into many other types of existing caps or protective headgear, even those without pockets. As an example, an insert 10 could be provided with an adhesive on one side, the adhesive allowing the insert to be affixed to a portion (such as a panel) of the interior of a cap or other protective headgear.

Figure 4:
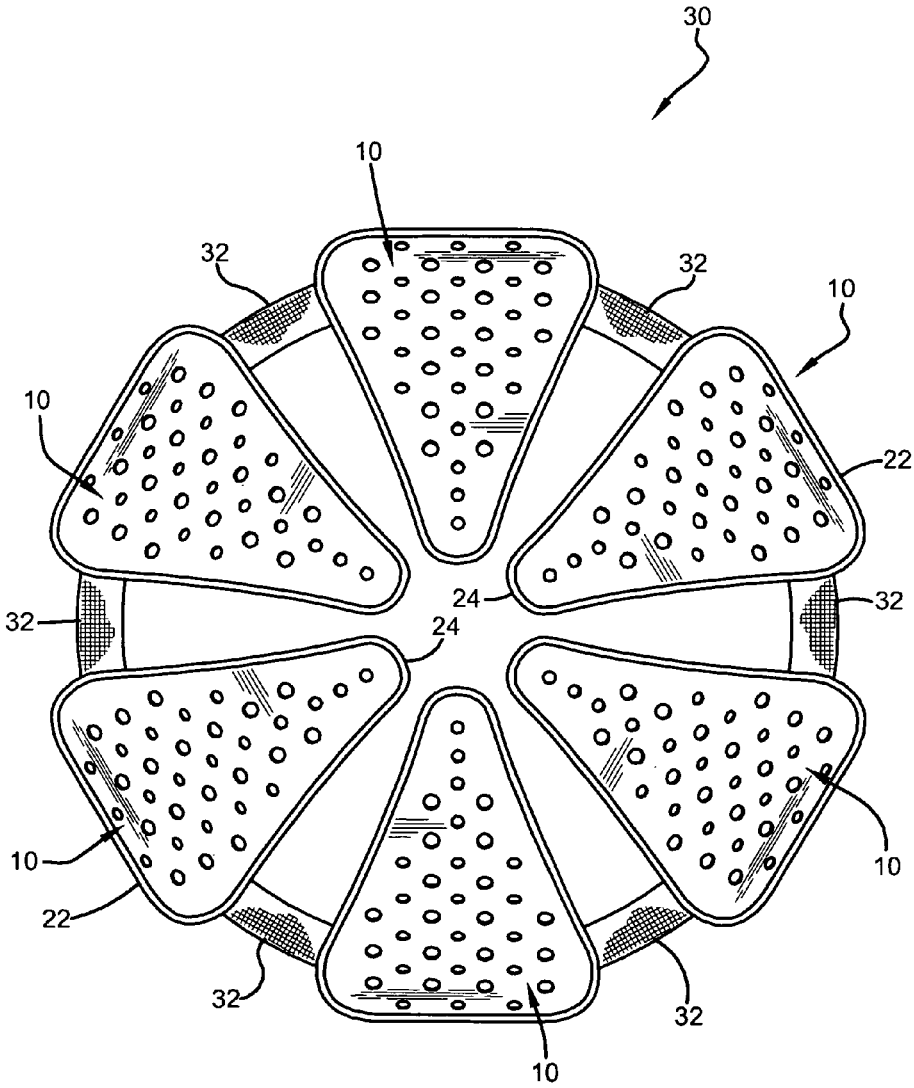
FIG. 4 depicts the inserts combined into an insert assembly according to the concepts of the present invention.

Several inserts 10 constructed according to the present invention may be combined into an insert assembly, such as insert assembly 30 shown in FIG. 4. As shown, insert assembly 30 includes six inserts 10 arranged in a ring and connected by straps 32. The individual inserts 10 are all situated so their respective bases 20 are on the outside of the ring and their vertices 24 are positioned inside the ring, with straps 32 extending between and attaching adjacent inserts 10 proximate bases 20. Straps 32 may be constructed of any suitable material, such as, for example, flexible plastic, elasticized cloth, plain cloth, or the like. Of course, an insert assembly could comprise any number of individual inserts, and the number of inserts comprising the insert assembly may be chosen depending on a particular protective headgear application. For example, insert assembly 30 has six inserts 10 to correspond to the six panels of a conventional baseball cap, as will be described more fully below.

Figure 6:
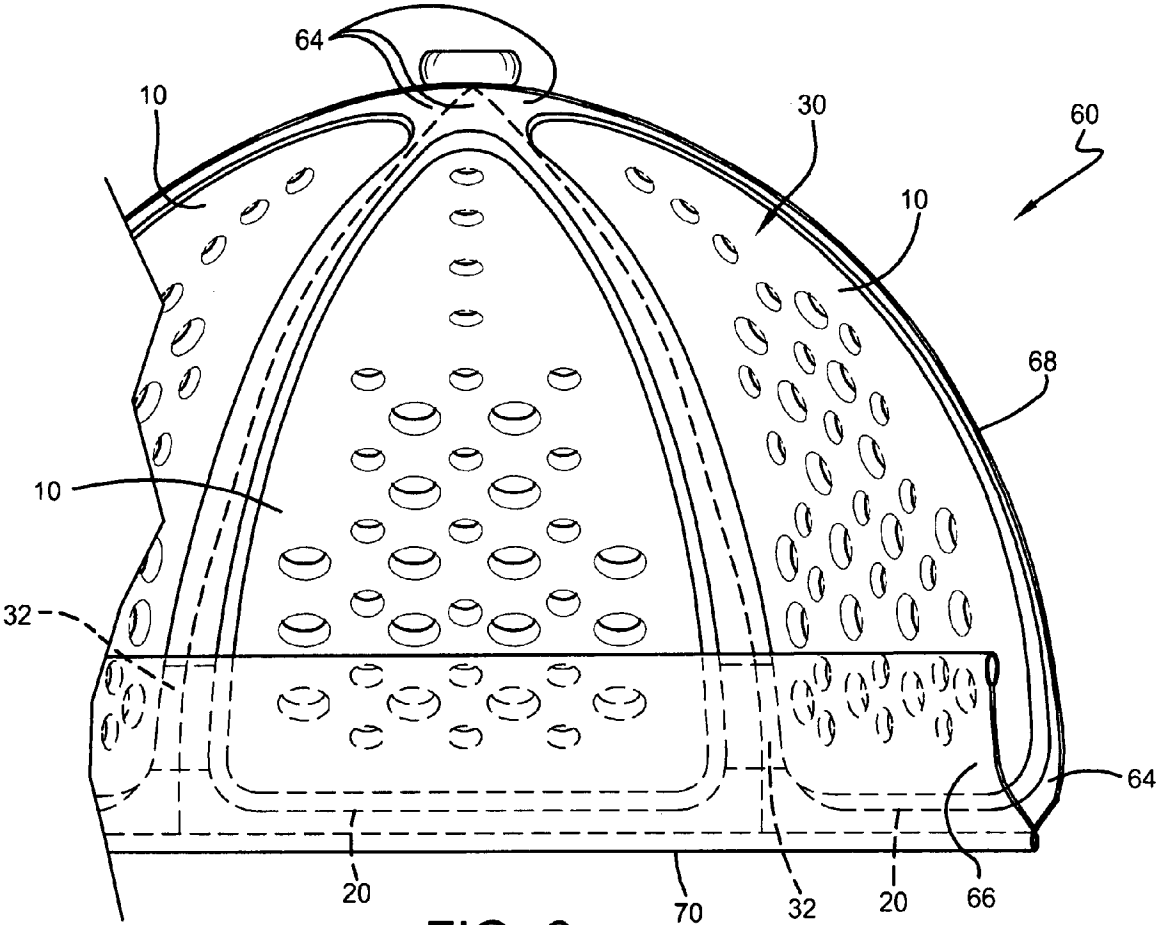
FIG. 6 is a fragmented elevational view showing an insert assembly of FIG. 4 positioned within a protective headgear cap.

As shown in FIG. 6, an insert assembly, such as insert assembly 30, can be positioned into protective headgear 60 which also takes on the form of a conventional baseball cap. Headgear 60 includes panels 64, head covering portion 68 and bases 70. A headband 66 is provided on the interior of a head covering portion 68 and is attached to base 70. To install insert assembly 30, headband 66 is folded down and each insert 10 of the insert assembly 30 is inserted between headband 66 and panels 64 so that the bases 20 of the individual inserts 10 of insert assembly 30 are positioned proximate base 70 of head covering portion 68 of protective headgear 60. As previously discussed, insert assembly 30 includes six individual inserts 10 that correspond to the six panels 64 of protective headgear cap 60. Insert assemblies having any number of individual inserts could also be provided. In addition, the insert assemblies could also be incorporated into many other types of existing caps or protective headgear, even those without a headband. By providing an insert assembly having appropriately placed adhesive, for example, the insert assembly could be affixed to a portion of the interior of a cap or other protective headgear.

Inserts constructed according to the concepts of the present invention, insert assemblies and protective headgear having such inserts or insert assemblies provide several advantages over prior art forms. The protective headgear disclosed herein takes on the appearance of a conventional cap while including impact-absorbing inserts for protecting a user. Moreover, the inserts and insert assemblies are replaceable and may be used in many types of caps or protective headgear. In addition, the inserts may include a filler material that is chosen for its desired effectiveness at absorbing impacts, while at the same time providing ventilation by virtue of the apertures, allowing heat created by the user to be more easily transferred to the adjacent environment. Also, by including apertures, the insert may better dampen impacts and can include less filler material than an insert without apertures.

It is thus evident that inserts constructed as described herein may be used in protective headgear that comfortably fits the head of most users while protecting the user from injury, thus accomplishing the objects of the invention and substantially improving the art.

What is claimed is:

1. Protective headgear comprising a cap having a head covering portion, an insert assembly positioned within said head covering portion, said insert assembly including a plurality of inserts and at least one strap, each said insert being attached to an adjacent insert by the least one strap, the inserts having an exterior surface defining an interior volume, a filler material in said interior volume, and a plurality of apertures in said exterior surface, wherein each said exterior surface includes a plurality of layers, said layers being joined together at seams at their peripheries thereby defining said interior volume.

2. The headgear of claim 1, wherein each said insert includes a base, said at least one strap extending between adjacent inserts proximate said bases.

3. Protective headgear adapted to protect a user comprising a cap having a plurality of pockets therein, an impact-absorbing insert positioned in each of said pockets, each said insert having opposed exterior surfaces defining an interior volume, said exterior surfaces including a plurality of layers being joined at seams at their peripheries thereby defining said interior volume, an impact-absorbing filler material in said interior volume, a plurality of apertures extending between said exterior surfaces, and through the impact-absorbing filler material.

4. The protective headgear of claim 3, wherein said filler material includes a gas.

5. The protective headgear of claim 3, wherein said filler material includes a sheer thickening fluid.

* * * * *